US010954036B2

(12) United States Patent
Santillan et al.

(10) Patent No.: US 10,954,036 B2
(45) Date of Patent: Mar. 23, 2021

(54) SUPPORT ELEMENT FOR COSMETIC PRODUCTS

(71) Applicant: GOTHA COSMETICS S.R.L., Lallio (IT)

(72) Inventors: Marcelo Santillan, Lallio (IT); Fabio Moroni, Lallio (IT)

(73) Assignee: GOTHA COSMETICS S.R.L., Lallio (IT)

( * ) Notice: Subject to any disclaimer, the term of this patent is extended or adjusted under 35 U.S.C. 154(b) by 0 days.

(21) Appl. No.: 16/447,260

(22) Filed: Jun. 20, 2019

(65) Prior Publication Data

US 2019/0389624 A1 Dec. 26, 2019

(30) Foreign Application Priority Data

Jun. 20, 2018 (IT) ..... 102018000006518

(51) Int. Cl.

| | |
|---|---|
| ***B65D 25/02*** | (2006.01) |
| ***A45D 40/18*** | (2006.01) |
| ***B65D 25/10*** | (2006.01) |
| *A45D 40/00* | (2006.01) |

(52) U.S. Cl.

CPC ..... *B65D 25/02* (2013.01); *A45D 40/18* (2013.01); *B65D 25/108* (2013.01); *A45D 2040/0006* (2013.01); *A45D 2200/05* (2013.01)

(58) Field of Classification Search

CPC combination set(s) only.

See application file for complete search history.

(56) References Cited

U.S. PATENT DOCUMENTS

| | | | | |
|---|---|---|---|---|
| 1,362,808 | A * | 12/1920 | McFarland | A45D 40/265 401/130 |
| 1,801,762 | A * | 4/1931 | Brun | A45D 33/025 132/307 |
| 3,229,810 | A * | 1/1966 | Goller | B65D 75/305 206/467 |
| 6,009,885 | A * | 1/2000 | Nam | A45D 33/006 132/293 |
| 7,047,983 | B2 * | 5/2006 | Manougian | A45D 33/006 132/294 |
| 7,726,322 | B2 * | 6/2010 | Cho | A45D 33/04 132/294 |
| 8,651,119 | B2 * | 2/2014 | Byun | A45D 33/26 132/294 |
| 9,226,563 | B2 * | 1/2016 | Silva | A45D 44/005 |
| 9,783,343 | B2 * | 10/2017 | Seguin | A45D 33/006 |
| 9,826,824 | B2 * | 11/2017 | Lim | A46B 17/06 |
| 9,897,378 | B2 * | 2/2018 | Palmer | F26B 25/06 |
| 10,278,477 | B2 * | 5/2019 | Teller | A45D 40/00 |
| 2014/0231304 | A1 * | 8/2014 | Lee | A45D 33/006 206/581 |

* cited by examiner

*Primary Examiner* — Monica E Millner

(74) *Attorney, Agent, or Firm* — Nixon & Vanderhye

(57) ABSTRACT

Disclosed is a support element for a cosmetic product in paste or semi-solid form, of the type adapted to be supplied in a case, including a plate with an outer surface, adapted to be fixed to the case, and an inner surface, adapted to be coupled with the cosmetic product, wherein the support element is made of a plastic material.

10 Claims, 3 Drawing Sheets

SUPPORT ELEMENT FOR COSMETIC PRODUCTS

BACKGROUND OF THE INVENTION

Field of the Invention

The present invention relates to a support element for cosmetic products, in particular for cosmetic products in paste or semi-solid form, such as foundation, eye shadows, lipsticks or the like.

More in detail, the invention relates to a support for cosmetic products of "pod" type, i.e., with a flattened shape, generally supplied in a case. In general, these products are formed on a support element, coupled to the lower side of the pod, which in turn is fixed to the base of the case, for example by gluing.

Description of the Related Art

Typically, these cosmetic products, defined in the field as "poured" are obtained with a forming process in which the product is taken to liquid state by heating, is poured into a mold adapted to give it the pod shape and provide any surface decorations required and subsequently solidified by cooling.

According to this process, the support element is inserted into the mold used for forming so that adhesion between the cosmetic product and said support takes place during solidification of the mixture.

In general, the bottom surface of the mold comprises the negative profile of the upper, or exposed, surface of the cosmetic product. The upper part of the mold is instead closed by the support element that thus remains on the bottom of the product.

A volume is defined between the bottom surface of the mold and the support element and is filled completely with the cosmetic product in liquid state, so that it comes into contact with the side of the support element facing the inside of the mold and can therefore cling to it during solidification.

Support elements currently in use comprise a metal plate whose perimeter has a shape corresponding to that of the housing of the case, for example circular, oval, etc.

The plate generally has a raised perimeter edge and is provided with one or more openings through which the liquid cosmetic product is poured to fill the mold.

Nonetheless, support elements produced in this way have some problems.

Among these, the most relevant is weak adhesion between the inner, or upper, surface of the support element and the cosmetic product.

In fact, for this type of product it is important that the pod remains adhering to the case until it is empty. This adhesion must also be guaranteed in the case of small impacts or knocks that the case may be subjected to during daily use. For this reason, a quality control that is typically carried out on these cosmetic products is that the pod must remain attached to the support element even after the case is dropped several times (in general, tests include three falls) from a height of a few centimeters (in general, around 30 cm).

Products that do not pass the aforesaid test, i.e., that become detached from the support element, must be rejected.

With known support elements the percentage of rejected products, i.e. that do not have sufficient adhesion or grip of the product to the support element, is very high and in some can reach or exceed 30% of the production. It is clear that such a high number of rejects has a negative influence on production costs, and hence on the cost of the finished product, but also on the production times.

Moreover, these known support elements have a relatively high cost due to the metal material used and to the machining processes required to give them their final shape.

SUMMARY OF THE INVENTION

Therefore, in the sector there is a need to provide a support element for cosmetic products in paste or semi-solid form that overcomes the limits of the prior art.

In particular, an object of the present invention is to propose a support element that ensures a stronger and longer lasting adhesion with the cosmetic product than those of the prior art.

Another object of the present invention is to provide a support element that allows both the costs and the production times of the cosmetic products to be reduced.

These and other objects are achieved by a support element for a cosmetic product in paste or semi-solid form, of the type adapted to be supplied in a case, comprising a plate with an outer surface, adapted to be fixed to the case, and an inner surface, adapted to be coupled with said cosmetic product. The shape of the plate is generally, but not necessarily, circular. In fact, as a function of the shape of the case to which it must be fixed, the plate can also have different shapes, such as oval, quadrilateral, etc.

According to an advantageous aspect of the invention, the support element is made of a plastic material.

Due to the use of this material, in place of the metal used in the prior art, it is possible to obtain a much firmer and longer lasting adhesion of the pod of solidified product to the support element.

In fact, as the plastic material has a higher coefficient of thermal expansion than metal, during pouring of the heated product (in general, to around 90° C.) and during subsequent cooling (in general, to around −20° C.) it expands and contracts in a manner more similar to the formulation of the cosmetic product. This prevents, especially during cooling, the lower surface of the pod of product from detaching from the plate in some areas reducing the useful coupling surface.

Examples of materials suitable for this purpose are, for example, the copolymer acrylonitrile-butadiene-styrene (ABS) or polymers with equivalent mechanical properties.

According to another aspect of the invention, the inner surface of the plate is rough. The surface produced in this way, instead of the smooth surface of metal support elements, also contributes to increasing the adhesion strength of the product to said inner surface of the plate.

For the same purpose, according to another aspect of the invention, the plate is provided with an opening, through which the liquid cosmetic product is poured during the production process, arranged in the central area. Said opening is delimited by a raised edge projecting from the inner surface.

Said raised edge forms a further gripping point of the cosmetic product to the support.

According to a preferred variant, the plate is provided with two identical openings, arranged symmetrically with respect to an axis of symmetry.

Said openings are preferably substantially ring, elliptical or oval shaped.

According to a preferred embodiment, also the lateral edge of the plate is raised and projecting from the inner surface, so as to laterally contain, at least for a segment, the pod of cosmetic product.

The aforesaid edge of the openings, the lateral edge of the plate and the rough inner surface can be obtained simply and without any substantial increase in the costs of the support element. In fact, due to the use of the plastic material, said element can be produced by molding or similar procedures.

The support produced in this way, notwithstanding the peculiarities in shape described above, is less expensive and performs better than metal supports of the prior art.

According to another aspect of the invention, the support element comprises a plurality of holes arranged in proximity of the perimeter of the plate.

These holes facilitate complete filling of the mold and in particular allow the elimination of air bubbles that could remain trapped between the bottom of the product (pod) and the inner surface of the plate, reducing the adhesion surface.

According to another aspect of the invention, cavities or small hollows are produced on the outer surface of the plate. These cavities allow a better distribution of the adhesive material used to fix the support element to the case and hence increase the grip between said elements.

BRIEF DESCRIPTION OF THE DRAWINGS

Further features and advantages of the present invention will become more apparent from the description of an example of a preferred, but not exclusive, embodiment, of a support element as illustrated in the accompanying figures, wherein.

DESCRIPTION OF THE PREFERRED EMBODIMENTS

Figure 1:
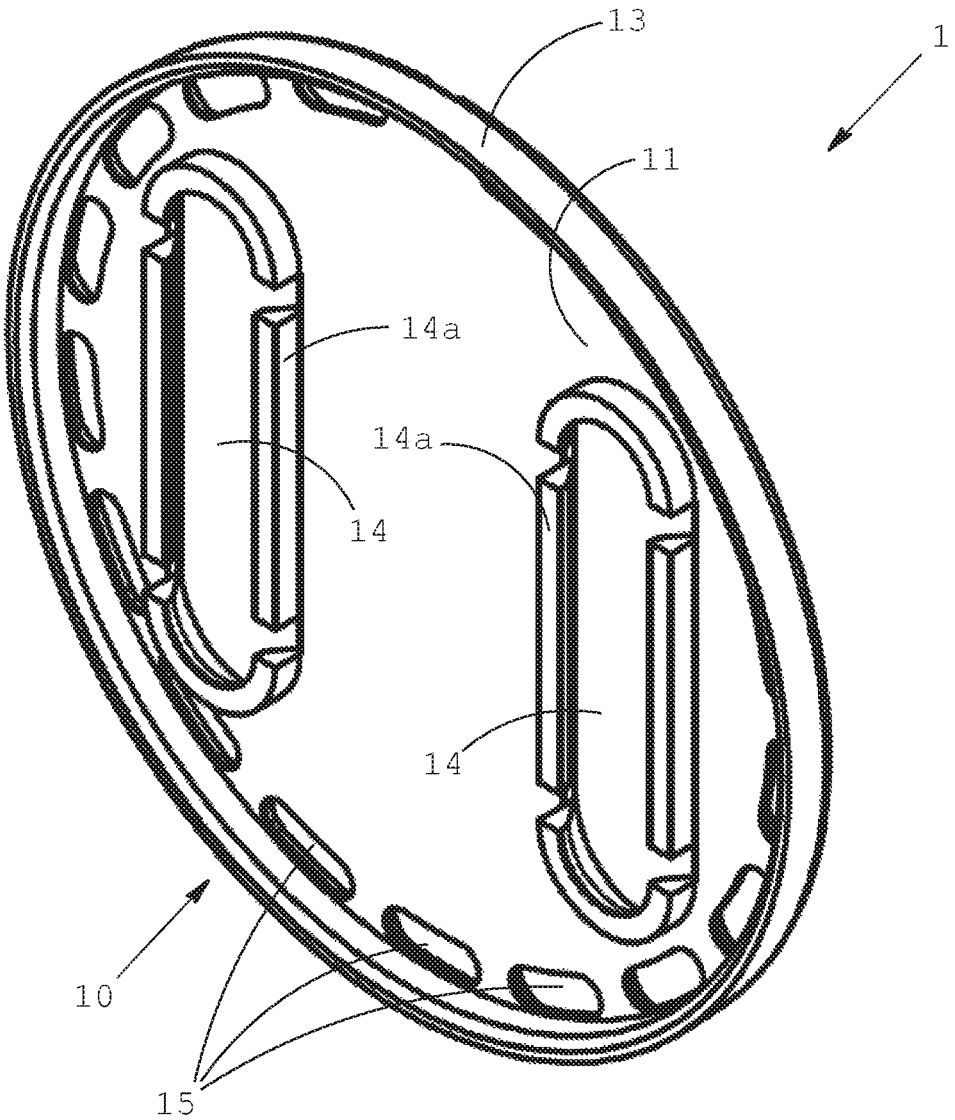
FIG. 1 is a perspective view of the support element according to the invention.
Figure 2:
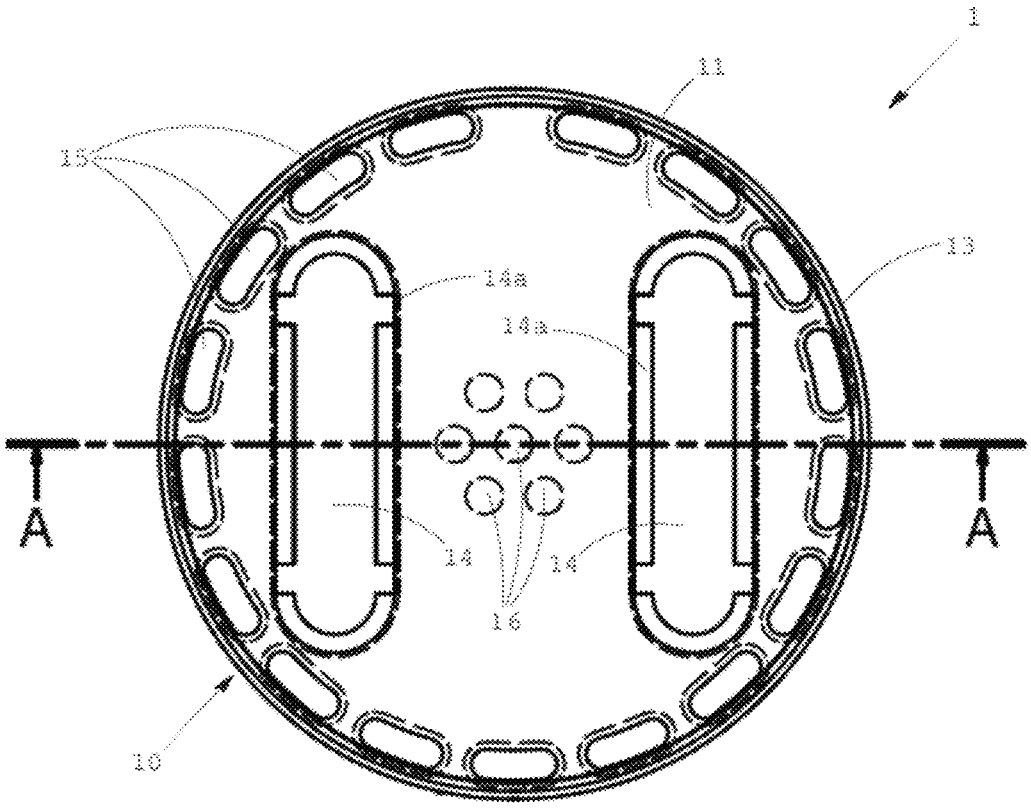
FIG. 2 is a plan view of the support element of FIG. 1.
Figure 3:
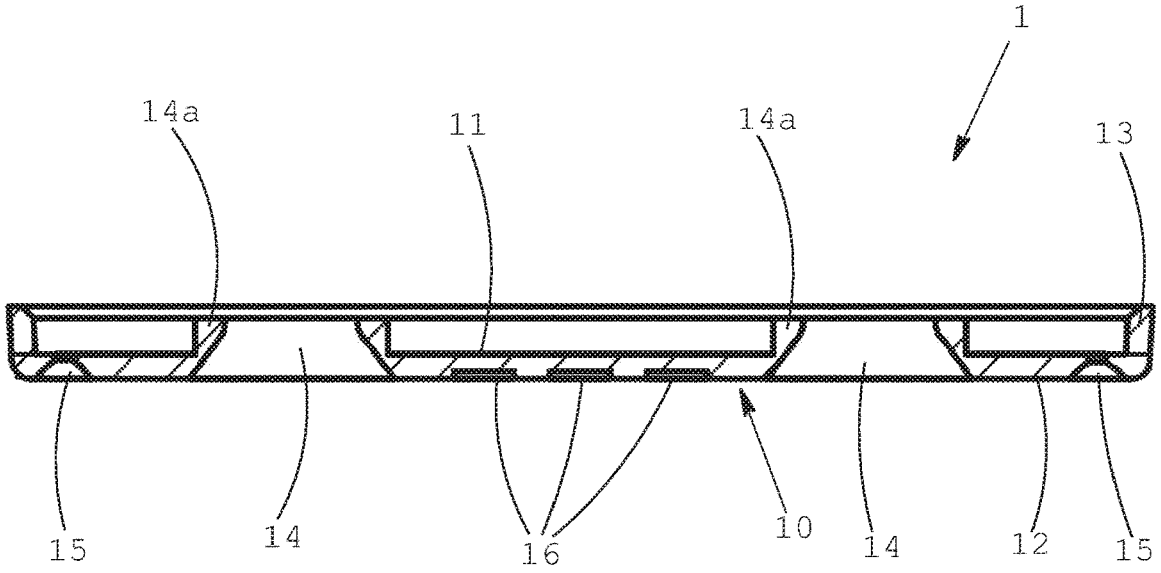
FIG. 3 is a side view of the support element of FIG. 2, sectioned along a transverse plane A-A.
Figure 4:
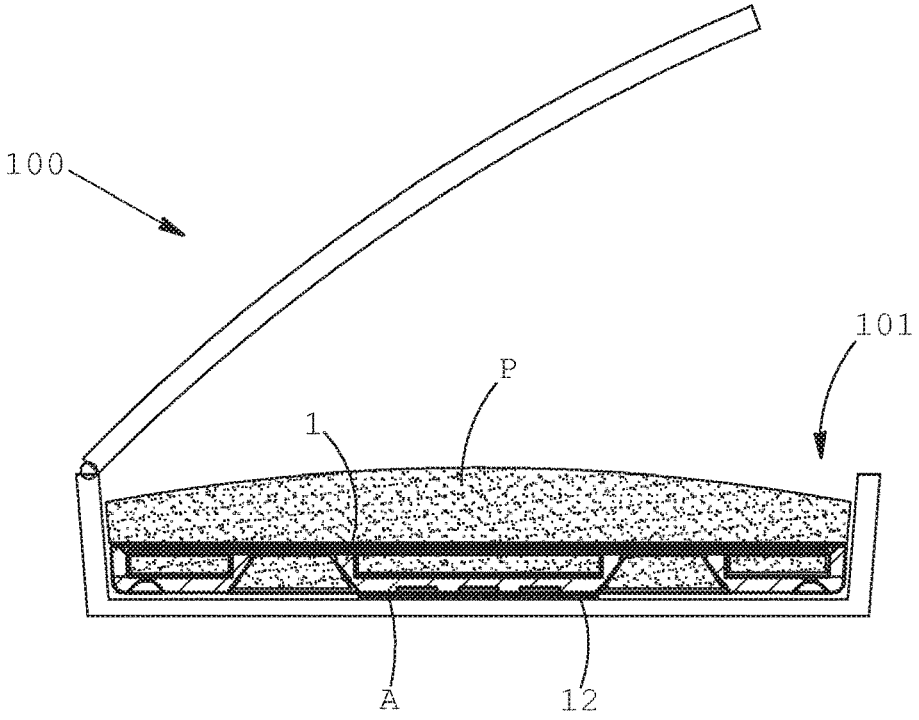
FIG. 4 is a sectional view of a case for cosmetics containing a pod of cosmetic product coupled to a support element according to the invention.

With reference to the accompanying figures, the numeral 1 indicates as a whole the support element for cosmetic products. The support element 1 comprises a substantially circular shaped plate 10, whose two faces are defined as inner surface 11 and outer surface 12. These inner and outer references refer to the condition of use of the support element in which the inner surface 11 is intended to couple stably with the cosmetic product P and the outer surface 12 is fixed to a housing 101 of a case 100, as illustrated in FIG. 4.

The thickness of the plate 10 is typically constant and is preferably comprised between 0.5 mm and 2.5 mm Preferably, the thickness is of around 1 mm.

The plate 10 has a perimeter edge 13 slightly raised so as to project from the inner surface 11.

Two openings 14, arranged symmetrically to an axis of symmetry (not represented in the figures), are produced in the central area of the plate 10.

In the embodiment illustrated, said openings 14 are substantially ring shaped with the two long sides rectilinear and mutually parallel.

Advantageously, according to the invention, the edge 14*a* of the openings 14 is raised and projecting from the inner surface 11.

The height or extension of the edge 14*a* of the openings and of the perimeter edge 13 is preferably comprised between 1 mm and 3 mm and more preferably is of around 2 mm.

Moreover, a plurality of vent holes 15 are provided along the circumferential edge of the plate 10. As mentioned above, said holes 15 allow all the air to flow out from inside the mold during filling with the liquid cosmetic product, helping to reduce or prevent the persistence of air bubbles or pockets inside the pod and at the interface with the support element.

Instead, cavities or hollows 16 are produced on the outer surface 12 of the plate 10. Said cavities 16 help to distribute the adhesive material A that is applied to the outer surface 12 for fixing the support element to the case 100.

The support element 1 is preferably made of ABS by a molding process. According to a preferred variant, the mold of the support element is configured so as to obtain a rough or in any case not completely smooth inner surface 11.

The surface thus obtained adheres more firmly to the lower surface of the pod of the cosmetic product once this has solidified.

Preferably, the support element is colorless and transparent or translucent. In this way, during the quality control visual inspection it is possible to detect any air bubbles trapped between the inner surface 11 and the bottom of the cosmetic product.

Preferably, the said support element is made of a plastic material having good transparency proprieties, generally having a haze value equal to or less than 25%, preferably equal to or less than 20%, more preferably equal to or less than 10%. Indicatively, the plastic material has a light transmittance value that may be, approximately, at least of 85%, generally at least of 90%, measured on a 2.5 mm thick sheet at room temperature. The said proprieties are measured in accordance with the ASTM D-1003 method.

The invention has been described for illustrative and non-limiting purposes according to some preferred embodiments thereof. Those skilled in the art may find numerous other embodiments and variants, all falling within the scope of protection of the claims below.

The invention claimed is:

1. A support element for a cosmetic product in paste or semi-solid form, configured to be supplied in a case, said support element comprising:

a plate with an outer surface configured to be fixed to the case, and an inner surface configured to be coupled with said cosmetic product in paste or semi-solid form, the plate being made of a plastic material, the plate being provided with at least one opening defined through a central area of the plate that is central with respect to an outer circumferential portion of the plate, said opening being delimited by a raised edge raised and projecting from the inner surface of the plate; and a plurality of holes defined in proximity of a perimeter edge of the plate.

2. The support element according to claim 1, wherein said plastic material is Acrylonitrile Butadiene Styrene (ABS).

3. The support element according to claim 1, wherein the inner surface of the plate is rough.

4. The support element according to claim 1, wherein a perimeter edge of the plate is raised and projecting from the inner surface.

5. The support element according to claim 1, wherein cavities are defined on the outer surface of the plate to ensure grip of an adhesive material used to fix the support element to the case.

6. The support element according to claim 2, wherein the inner surface of the plate is rough.

7. The support element according to claim 2, wherein a perimeter edge of the plate is raised and projecting from the inner surface.

8. The support element according to claim 3, wherein a perimeter edge of the plate is raised and projecting from the inner surface.

9. The support element according to claim 2, wherein cavities are defined on the outer surface of the plate to ensure grip of an adhesive material used to fix the support element to the case.

10. The support element according to claim 3, wherein cavities are defined on the outer surface of the plate to ensure grip of an adhesive material used to fix the support element to the case.

* * * * *